US007926969B2

(12) United States Patent
Hsiao et al.

(10) Patent No.: US 7,926,969 B2
(45) Date of Patent: Apr. 19, 2011

(54) METHOD FOR CONTROLLING BRIGHTNESS AND INCREASING UNIFORMITY OF LIGHT GENERATED BY LAMBERTIAN SURFACE SOURCES

(75) Inventors: Chin-Tin Hsiao, Jhongli (TW); Jyh-Lih Wang, Jhongli (TW); Hui-Hsin Kao, Jhongli (TW)

(73) Assignee: Trend Lighting Corp., Jhongli, Taoyuan Hsien (TW)

( * ) Notice: Subject to any disclaimer, the term of this patent is extended or adjusted under 35 U.S.C. 154(b) by 228 days.

(21) Appl. No.: 12/400,114

(22) Filed: Mar. 9, 2009

(65) Prior Publication Data

US 2010/0226129 A1 Sep. 9, 2010

(51) Int. Cl.
*F21S 8/00* (2006.01)

(52) U.S. Cl. ..... 362/147; 362/249.02; 362/249.03

(58) Field of Classification Search ..... 362/145, 362/147, 148, 249.01, 249.02, 249.03
See application file for complete search history.

(56) References Cited

U.S. PATENT DOCUMENTS

2008/0279541 A1* 11/2008 Montgomery et al. ..... 396/62
* cited by examiner

*Primary Examiner* — David V Bruce
(74) *Attorney, Agent, or Firm* — Alan Kamrath; Kamrath & Associates PA

(57) ABSTRACT

A method for controlling the brightness and increasing uniformity of light generated by Lambertian surface sources has the steps of providing multiple pairs of Lambertian surface sources to produce light emitting on a target surface, each pair of Lambertian surface sources consisting of two Lambertian surface sources; rotating the two Lambertian surface sources of the same pair by a same rotation angle relative to the target surface but in opposite directions; calculating a maximum illumination and a minimum illumination corresponding to the rotation angle; determining whether a ratio of the maximum illumination to the minimum illumination is lower than a threshold; and fixing the Lambertian surface sources at the rotation angle if the ratio is lower than the threshold.

10 Claims, 3 Drawing Sheets

METHOD FOR CONTROLLING BRIGHTNESS AND INCREASING UNIFORMITY OF LIGHT GENERATED BY LAMBERTIAN SURFACE SOURCES

BACKGROUND OF THE INVENTION

1. Field of the Invention

The invention relates to a method for controlling the brightness and increasing uniformity of light generated by Lambertian surface sources, and more particularly to a method that controls the Lambertian surface sources to produce even light on a target surface.

2. Description of Related Art

Lighting devices are indispensable illuminating equipment in life and widely applied in either indoor or outdoor space, for example the street lights. Although the lighting devices have been developed for many years, the lighting device still can be improved in some aspects, such as energy converting efficiency between electricity and light. Conventional tungsten bulbs only convert approximate 5% of electrical energy to light energy, while other 95% of electrical energy turns to heat energy. In addition to the drawback of low energy converting efficiency, the generated heat energy generally results in heat-dissipating problems.

In view of the foregoing drawbacks of the conventional illuminating devices, LED-based lighting devices with features of low power consumption, long useful life are developed. However, the lighting angle of the LED-based lighting devices are limited to small degrees. Since the LED are designed to focus its light, the LED cannot be used in applications needing a spherical or wide light field.

With reference to FIG. 4, multiple Lambertian surface sources (70) are arranged in a line with equal intervals and radiates a target surface such as the ground. If the area (A) and flux (P) of each Lambertian surface source (70) are known, the brightness (N) can be expressed by $$N = \frac{P}{\pi A}.$$

The illumination distribution is shown on FIG. 5. An angle $\alpha$ can be defined between a virtual normal of the Lambertian surface source (70) and a virtual line, where the virtual normal is perpendicular to the target surface at a point, and the virtual line extends from the edge of the Lambertian surface source (70) to the same point on the target. The angle $\alpha$ can be expressed by $$\alpha = \tan^{-1}\left(\frac{X}{2L}\right),$$

wherein X is a diameter of each Lambertian surface source (70) and L is the distance from the target surface to the Lambertian surface source (70), i.e. the length of an opposite side of the right triangle with the internal angle $\alpha$.

With reference to FIG. 6, a center illumination ($H_0$) on the target surface and other illumination values ($H_\theta$) along other included angles ($\theta$) on the target surface can be calculated.

$$H_0=\pi N \sin^2 \alpha$$

$$H_\theta=H_0 \cos^4 \theta$$

The center illumination ($H_0$) has the maximum value than other illumination values ($H_\theta$) along other included angles ($\theta$). Still referring to FIG. 5, in order to generate even illumination on the target surface, a portion of lighting area provided by one Lambertian surface source (70) overlaps a portion of lighting area provided by an adjacent Lambertian surface source (70). Although the light emitting from different Lambertian surface source (70) may radiate the same region to minimize the difference between the illumination value ($H_\theta$) and the center illumination ($H_0$), the illumination intensity on the overlapped region is still insufficient.

To overcome the shortcomings, the present invention provides a method for controlling brightness and increasing uniformity of light generated by Lambertian surface sources to mitigate or obviate the aforementioned problems.

SUMMARY OF THE INVENTION

The main objective of the present invention is to provide a method that improves the uniformity of light generated by Lambertian surface sources so as to provide even lighting on a target surface.

To accomplish the objective, the method has the steps of providing multiple pairs of Lambertian surface sources to produce light emitting on a target surface, each pair of Lambertian surface sources consisting of two Lambertian surface sources; rotating the two Lambertian surface sources of the same pair by the same rotation angle relative to the target surface but in opposite directions; calculating a maximum illumination and a minimum illumination corresponding to the rotation angle; determining whether a ratio of the maximum illumination ($H_0'$) to the minimum illumination ($H_{\theta\beta}$) is lower than a threshold; and fixing the Lambertian surface sources at the rotation angle if the ratio is lower than the threshold.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
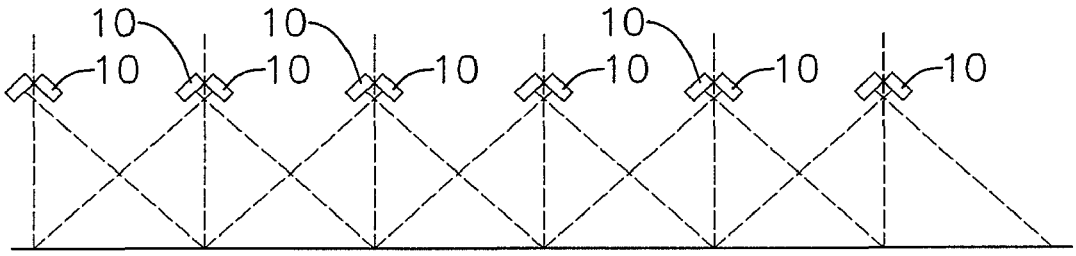
FIG. 1 is a schematic view of multiple Lambertian surface sources being separated to multiple pairs and arranged at an incline angle in accordance with the present invention.

With reference to FIG. 1, the present invention is a method for controlling brightness and increasing uniformity of light produced by Lambertian surface sources (10).

The multiple Lambertian surface sources (10) are grouped into multiple pairs to produce light radiating on a target surface and may be separated by the same interval. Each pair of the Lambertian surface sources (10) includes two Lambertian surface sources (10) that face in opposite directions and incline at the same angle relative to the target surface.

Figure 2:
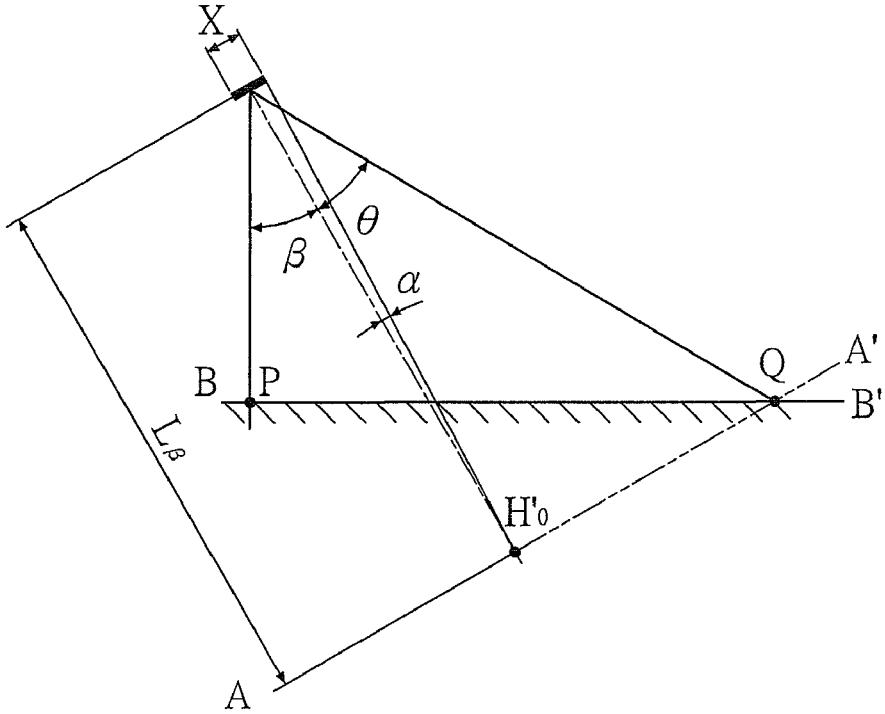
FIG. 2 is schematic view of a Lambertian surface source inclining at an angle in accordance with the present invention.

With reference to FIG. 2, when the Lambertian surface source (10) rotates by an rotation angle β, the original distance (L) becomes ($L_\beta$), i.e. the length of an opposite side of the right triangle with the internal angle θ. Therefore a new center illumination ($H_0$') and a other illumination ($H_{\theta\beta}$) corresponding to the rotation angle β, and other illumination ($H_\theta$') along different included angles (θ) be calculated with following equations.

$$H'_0 = \pi N \sin^2\alpha, \text{ where } \alpha = \tan^{-1}\left(\frac{X}{2L_\beta}\right)$$

$$H'_\theta = H'_0 \cos^4\theta \text{(illuminance at } Q \text{ in } AA\text{'direction)}$$

$$H_{\theta\beta} = H'_0 \cos^4\theta \cos\beta \text{(illuminance at } Q \text{ in } BB\text{'direction, } BB\text{' is ground)}$$

As the Lambertian surface source (10) rotates from its present position to a new position by an rotation angle β, a new set of illumination values including a new center illumination at P ($H_\beta$') and a other illumination at Q($H_{\theta\beta}$) are accordingly produced. In the preferred embodiment in accordance with the present invention, the preferable ratio of the maximum in the admin value overlapped irradiance distribution between two Lambertion surface source (the distance in 36 meter this article) is required to be lower than 4:1.

With reference to the following table, the illuminations corresponding to different rotation angles β can be calculated by software when other ambient conditions are also concerned. For example, the ambient conditions may be that the Lambertian surface source (10) is equipped with a lampshade with an incline angle of 60 degrees, the distance between the Lambertian surface source (10) and the target surface is 12 meters and the interval between two adjacent pairs of Lambertian surface source (10) is 36 meters.

| Rotation angle β | Illumination | Unit (lux) |
|---|---|---|
| 30 degrees | Max. illumination | 40.71 |
| | Min. illumination | 9.87 |
| 35 degrees | Max. illumination | 37.065 |
| | Min. illumination | 9.97 |
| 40 degrees | Max. illumination | 33.523 |
| | Min. illumination | 10.06 |
| 45 degrees | Max. illumination | 30.775 |
| | Min. illumination | 10.29 |
| 50 degrees | Max. illumination | 27.596 |
| | Min. illumination | 11.46 |

When the rotation angle β is 30 degrees, the ratio of the maximum illumination to the minimum illumination is higher than 4:1. When the incline angle β is either 35, 40, 45 or 50 degrees, the ratio of the maximum illumination to the minimum illumination is lower than 4:1 and meets the preferred requirement.

With further reference to FIG. 1, each of the Lambertian surface sources (10) can be inclined at the rotation angle of 35, 40, 45 or 50 degrees relative to the surface of the target surface, wherein the angle of 50 degrees with the lowest ratio can produce good uniformity of light on the target.

Figure 3:
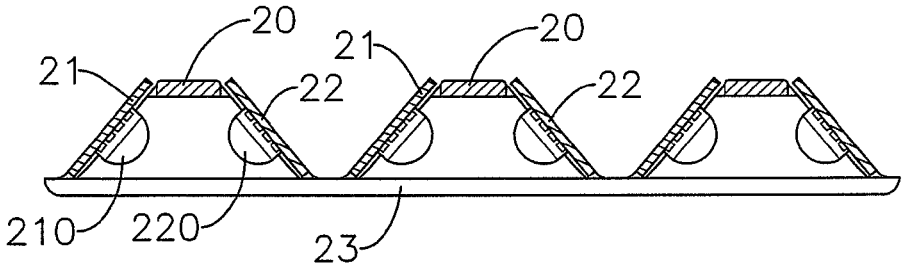
FIG. 3 is a plan view of an LED-based lighting device with multiple LED modules being configured in accordance with method of the present invention.
Figure 4:
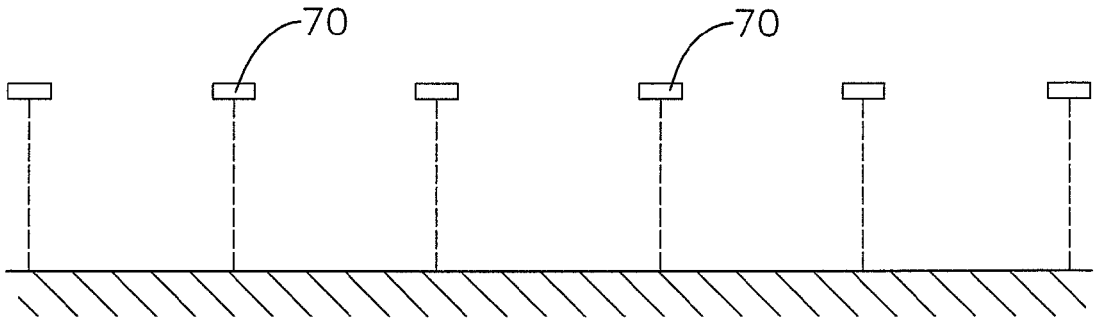
FIG. 4 PRIOR ART
FIG. 4 is a schematic view of multiple Lambertian surface sources being arranged in accordance with prior art.
Figure 5:
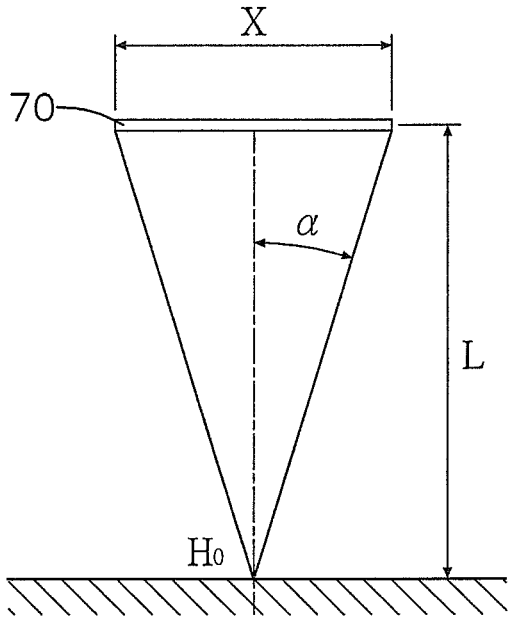
FIG. 5 PRIOR ART
FIG. 5 is a schematic view of illumination distribution of a Lambertian surface source in accordance with the prior art.
Figure 6:
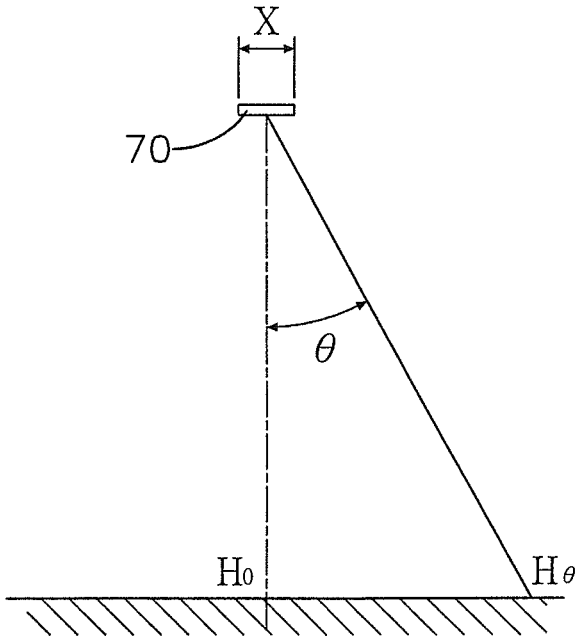
FIG. 6 PRIOR ART
FIG. 6 is another schematic view of illumination distribution of the Lambertian surface source in accordance with the prior art.

With reference to FIG. 3, the present invention is applied to an LED-based light device. The LED-based light device comprises a base (20) and multiple LED modules (21)(22) mounted on the base (20). Each LED module (21)(22) comprises a circuit board mounted with multiple LEDs (210) (220). The circuit boards incline at a determined angle relative to the base (20) in accordance with the present invention to produce even light. A transparent cover glass (23) for this illuminance system may be used.

Because the Lambertian surface sources (10) are grouped to multiple pairs and each pair has two Lambertian surface sources (10) that face in opposite directions and incline at the same angle, the light emitting from different Lambertian surface sources (10) can overlap on a relatively large area of the target. When the Lambertian surface sources (10) are arranged at a particular angle to produce a low ratio of the maximum illumination ($H_0$') to the minimum illumination ($H_{\theta\beta}$), the Lambertian surface sources (10) can produce even light on the target.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for controlling brightness and increasing uniformity of light produced by Lambertian surface sources, comprising steps of:

providing multiple pairs of Lambertian surface sources to produce light emitting on a target surface, each pair of Lambertian surface sources consisting of two Lambertian surface sources;

rotating the two Lambertian surface sources of the same pair by a same rotation angle relative to the target surface but in opposite directions;

calculating a maximum illumination and a minimum illumination corresponding to the rotation angle;

determining whether a ratio of the maximum illumination to the minimum illumination is lower than a threshold; and fixing the Lambertian surface sources at the rotation angle if the ratio is lower than the threshold.

2. The method as claimed in claim 1, wherein the threshold for the ratio is 4:1.

3. The method as claimed in claim 1, wherein the rotation angle is in a range of 35 to 50 degrees.

4. The method as claimed in claim 2, wherein the rotation angle is in a range of 35 to 50 degrees.

5. The method as claimed in claim 1, wherein a distance between adjacent pairs of the Lambertian surface is the same.

6. The method as claimed in claim 3, wherein a distance between adjacent pairs of the Lambertian surface is the same.

7. The method as claimed in claim 4, wherein a distance between adjacent pairs of the Lambertian surface is the same.

8. The method as claimed in claim 1, wherein the two Lambertian surface sources of the same pair are rotated toward each other.

9. The method as claimed in claim 2, wherein the two Lambertian surface sources of the same pair are rotated toward each other.

10. The method as claimed in claim 3, wherein the two Lambertian surface sources of the same pair are rotated toward each other.

* * * * *